United States Patent [19]

Wolff et al.

[11] Patent Number: 4,587,912

[45] Date of Patent: May 13, 1986

[54] SEWING MACHINE LUBRICATION SYSTEM

[75] Inventors: James W. Wolff, Chicago; Sandra J. Liakus, Lisle, both of Ill.

[73] Assignee: Union Special Corporation, Chicago, Ill.

[21] Appl. No.: 714,319

[22] Filed: Mar. 21, 1985

[51] Int. Cl.[4] ..... D05B 71/00

[52] U.S. Cl. ..... 112/256; 184/104.1

[58] Field of Search ..... 184/104 R, 6.22, 6.24, 184/26, 104.1; 112/256; 384/373, 398, 399

[56] References Cited

U.S. PATENT DOCUMENTS

| | | | |
|---|---|---|---|
| 2,705,458 | 4/1955 | Sunden | 184/26 X |
| 3,406,788 | 10/1968 | Weisz | 112/256 X |
| 3,416,633 | 12/1968 | Swearingen | 184/104 R |
| 3,555,962 | 1/1971 | Wolf et al. | 184/104.1 X |
| 3,658,153 | 4/1972 | Berman | 184/104.1 X |
| 3,953,707 | 4/1976 | Tanis | 184/104 R X |
| 4,122,789 | 10/1978 | Klundt | 112/256 |
| 4,245,575 | 1/1981 | Hsiao et al. | 112/256 |
| 4,458,642 | 7/1984 | Okubo et al. | 184/6.22 X |

*Primary Examiner*—Werner H. Schroeder
*Assistant Examiner*—Andrew M. Falik
*Attorney, Agent, or Firm*—John A. Schaerli

[57] ABSTRACT

A apparatus is provided for creating and maintaining lubricant pressure and flow to various operative mechanisms disposed within the frame of the sewing machine independent of the sewing machine operation. To aid in the lubrication process, a lubricant heater is provided. The lubricant heater operates independent of the sewing machine operation and serves to warm or heat the lubricant to a preset temperature before it is communicated to the bearing surfaces of the operative mechanisms. The invention may further include a device disposed between the lubricant pump and heater for filtering the lubricant before it is delivered to the operative mechanisms of the machine.

9 Claims, 7 Drawing Figures

SEWING MACHINE LUBRICATION SYSTEM

FIELD OF THE INVENTION

The present invent1on relates, in general, to sewing machines and, more particularly, to lubrication systems for sewing machines.

BACKGROUND OF THE INVENTION

Many of today's industrial sewing machines operate at extremely high speeds. To effect this end, adequate lubrication systems must be provided to dissipate heat and wear on the parts.

Pressurized lubrication systems are known in the art. In these systems, a sewing machine driven pump serves to withdraw lubricant from a reservoir and deliver it under pressure to the various mechanisms disposed throughout the machine frame. Because the pump is driven by the sewing machine, the circulation of lubricant is dependent on machine cycling. Therefore, there is an appreciable dely between the time the sewing machine is initially operated and the time optimum lubricant pressure and flow is effected to the operative mechanisms of the machine. In such systems, if a sewing machine is used to sew only a few stitches at a time in intermittent operation, it is possible for the sewing machine to run without ever reaching optimum lubrication pressure and flow throughout the entirety of the lubrication system.

Additional problems arise with pressurized lubrication systems. As with any lubricated part, operation is more efficient and effective after the lubricant has been warmed. That is, the power consumption for operating same and the lubricant flow characteristics are enhanced when operating with warmed lubricant. The machine lubricant in pressurized systems is warmed as a result of the frictional heat characteristics or build up of the machine. Unfortunately, up until now, there is an appreciable time dely between the time the sewing machine is initially operated and the time the lubricant has been warmed. Accordingly, during initial operation of the machine power consumption is greater and lubricant flow characteristics throughout the system are slowed.

In addition, problems have arisen because of the various speeds at which machines operate. Machines operating a lower speeds need a larger pump to deliver the necessary quantity of lubricant to the bearing surfaces. Machines operating a higher speeds required smaller pumps for delivering the necessary quantity of lubricant to the various parts requiring same. The effect on part inventory or stock is apparent.

BRIEF DESCRIPTION OF THE PRESENT INVENTION

Because of the above, and in accordance with the present invention, there is provided a unique lubrication system for sewing machines which obviates the problems addressed above. The problem of timely establishing optimum oil pressure and flow throughout the lubrication system is eliminated by providing a lubrication system which initiates and maintains lubricant pressure and flow throughout the system independent of the sewing machine operation. That is, with the present invention, there is provided a lubricant pump means which is driven independently of the machine operation whereby optimum oil pressure and flow can be established prior to commencement of the sewing operation or cycle. As a result wear on machine parts will advantageously be reduced.

The heretofore known problem of undue power consumption at the onset of the sewing operation is also minimized. With the present invention, the lubricant is warmed to a preset or predetermined temperature independent of the machine operation. Accordingly, the parts requiring lubricant may be supplied with a warmed lubricant prior to commencement of the sewing operation. Moreover, by heating the lubricant optimum flow throughout the entirety of the lubrication system may be established prior to sewing machine commencement. To accomplish these results, a lubricant heater means is provided. The lubricant heater means is disposed for heating the lubricant collected in the reservoir independent of sewing machine operation. The lubricant heater is controlled to selectively heat or warm the lubricant when the lubricant temperature is below a minimum optimum machine lubricant temperature.

The provision of a independently operated lubricant pump means also minimizes the above mentioned inventory or part problems. With the present invention, only one size of lubricant pump is required. Regardless of machine speed, the pump operation will provide an adequate supply of lubricant to the various mechanisms requiring same. Should more or less lubricant be required because of the particular machine operation or style, the independent operation of the pump may be modulated to effect the desired result. Moreover, by independently mounting the lubricant pump means outside of the machine frame, the machine can be designed to make the maximum use of the space required.

Because the unique device of the present invention is arranged outside of the machine frame, an oversized lubricant filter may be used to increase the volumetric capacity of the lubricant fluid which will contribute to machine cooling. In addition, the present invention provides means for improving the convective heat transfer from the lubricant.

It is therefore, a primary object of the present invention to provide a lubrication system for an intermittently operated sewing machine in which lubricant is supplied and maintained under pressure independently of the sewing machine operation.

Another object of the present invention is to provide a lubricant system for a sewing machine in which the lubricant is heated or warmed independent of the machine operation before it is supplied to the various mechanisms of the machine.

Another object of this invention is to provide means for circulating lubricant throughout the lubrication system independently of machine operation and which means for circulating is mounted apart from the machine.

Still another object of this invention is to provide means for circulating lubricant under pressure throughout the lubrication system of the machine independently of machine operation and which includes an oversized filtering apparatus which is readily disposed for servicing and which aids in the convection of heat from the lubricant.

Yet another object of this invention is to provide means for circulating lubricant under pressure throughout the lubrication system of the machine independent of the machine operation and which means for circulating can be readily applied to and removed from the sewing machine.

Still a further object of this invention is to provide in a sewing machine a lubrication system that is simple, economical, effective and dependable and that will provide for operation of the machine at very high speeds.

BRIEF DESCRIPTION OF THE DRAWINGS

Having in mind the above objects and other attendent advantages that would be evident from an understanding of this disclosure, the invention comprises the devices, combinations and arrangement of parts as illustrated in the presently preferred forms of the invention which are hereinafter set forth in detail to enable those skilled in the art to readily understand the function, operation, construction and advantages of same when read in conjunction with the accompanying drawings in which.

DETAILED DESCRIPTION OF THE PRESENT INVENTION

Figure 1:
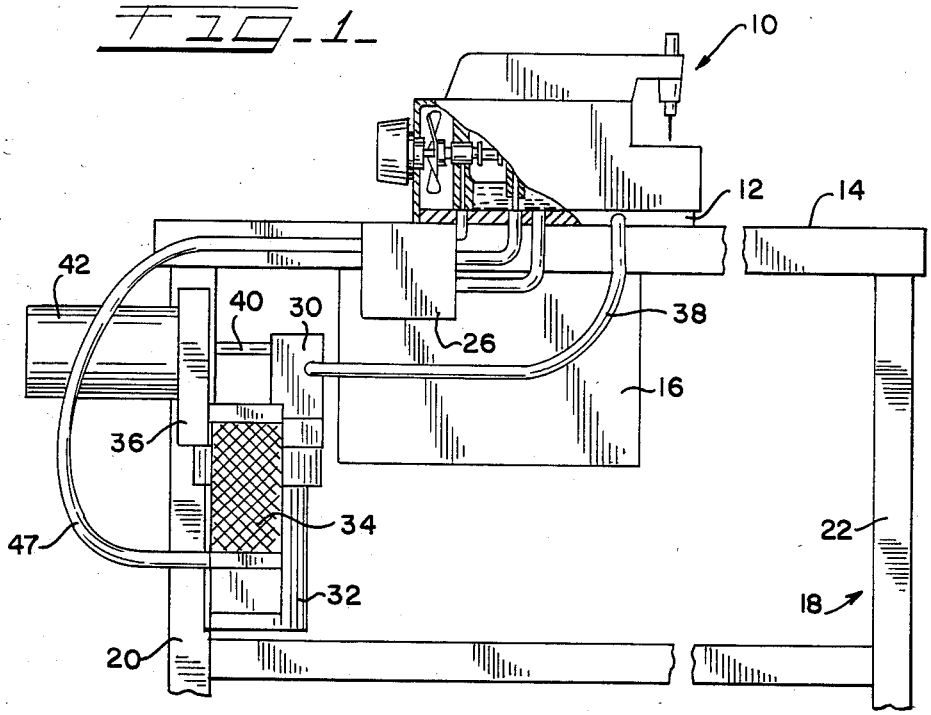
FIG. 1 schematically represents a fragmentary plan view of a sewing machine together with its driven means and supporting structure and having a lubrication system in accordance with the present invention.

Referring now to the drawings wherein like reference numerals indicate like parts throughout the several views, there is schematically illustrated in FIG. 1 a sewing machine 10. The sewing machine 10 includes a hollow frame having a series of operative mechanisms disposed therein. Secured to the open underside of the frame is a lubricant reception or reservoir means 12 which is adapted to receive lubricant that is to be delivered to the various operable mechanisms of the machine. The sewing machine is mounted on a table top 14 and is driven in the usual manner by a known electric power transmitter 16 mounted on the underside of the table top. Insofar as concerns the present invention, it is sufficient to note that the transmitter 16 continually rotates or runs and only intermittently, at the will of the operator, drives the sewing machine through a disengagable clutch mechanism arranged intergral with the transmitter. The table top 14 is supported by a stand assembly 18 that includes two pairs of upstanding legs 20 and 22.

The instant invention is adapted for use in connection with a wide variety of sewing machines. But, it has some special utility in relation to machines having a pressurized lubrication system. Preferably, and as known in sewing machines of this type, a lubrication system including plumbing is provided internally of the machine frame for directing lubricant from a lubricant reception or distribution means 26 to all the bearing surfaces requiring lubrication. The lubricant distribution means 26 and the internal lubrication system of the machine are not illustrated in detail in the drawings because this type of system is known in the art as evidenced from U.S. Pat. No. 4,245,575 granted to J. C. Hsiao, et al; the full disclosure of which is incorporated herein by reference.

The present invention concerns means for initiating or creating and maintaining lubricant flow and pressure throughout the lubrication system of the machine independent of machine operation. To accomplish this end, the present invention includes, in combination, lubricant pressure producing means 30, lubricant filtering means 32 and a lubricant heater means 34. The lubricant pressure producing means 30, lubricant filtering means 32 and lubricant heater means 34 may all be carried on a common support or housing 36. In the embodiment shown in FIGS. 1 through 5, the housing 36 is adapted to be fixedly secured to the leg 20 of the stand assembly 18.

It is anticipated that many lubricant pressure producing means could be used to practice the invention. The lubricant pressure producing means 30 of the present invention includes a pump assembly means which, in the preferred embodiment, is a positive displacement or gerotor type pump assembly. The pump means is provided with inlet and outlet means. The inlet means is fluidically connected to the machine reservoir means by means of a suitable conduit 38. As will be subsequently described, the outlet or discharge end of the pump means 30 is ultimately connected with the bearing surfaces requiring lubricant. The pump means 30 is operatively connected to one end of a horizontally disposed drive shaft 40. The other end of the drive shaft is connected to and driven by an independently operated electric motor means 42. That is, the motor and thereby the pump means are operated independently of the sewing machine. The motor means 42 may be fixedly secured to the housing 36 by any suitable fastener means. Because the motor and pump are operated independently of the machine operation, pressure and flow of lubricant through the lubrication system may be initiated or created and maintained before operation of the machine commences.

From the pump means 30, the lubrication flows to the lubrication filtering means 32. To accomplish this end, the housing 36 is provided with suitable conduits connecting the pump means 30 with the filtering means 32. The filtering means 32 is carried by the housing 36 such that is depends therefrom and is readily accessable for servicing. Moreover, the filter has a large lubricant capacity whereby increasing the overall volumetric capacity of the lubrication system of the machine.

Figure 2:
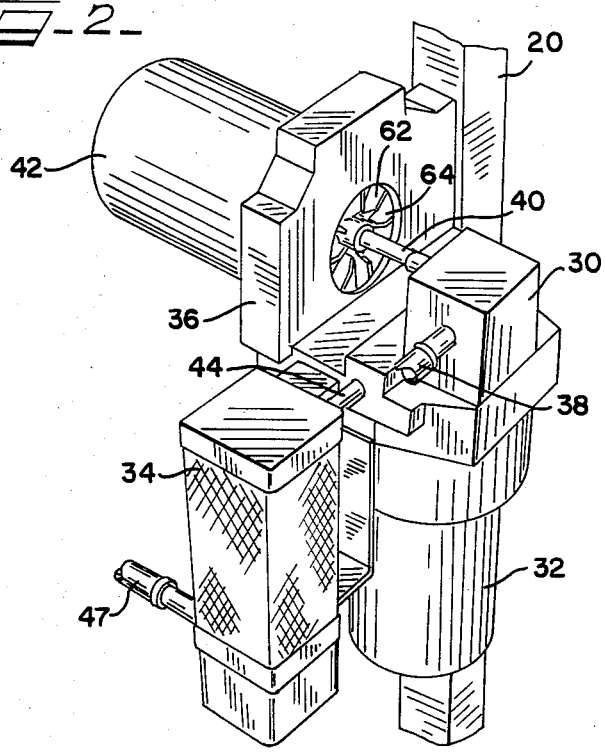
FIG. 2 is a detailed perspective view of the present invention.
Figure 4:
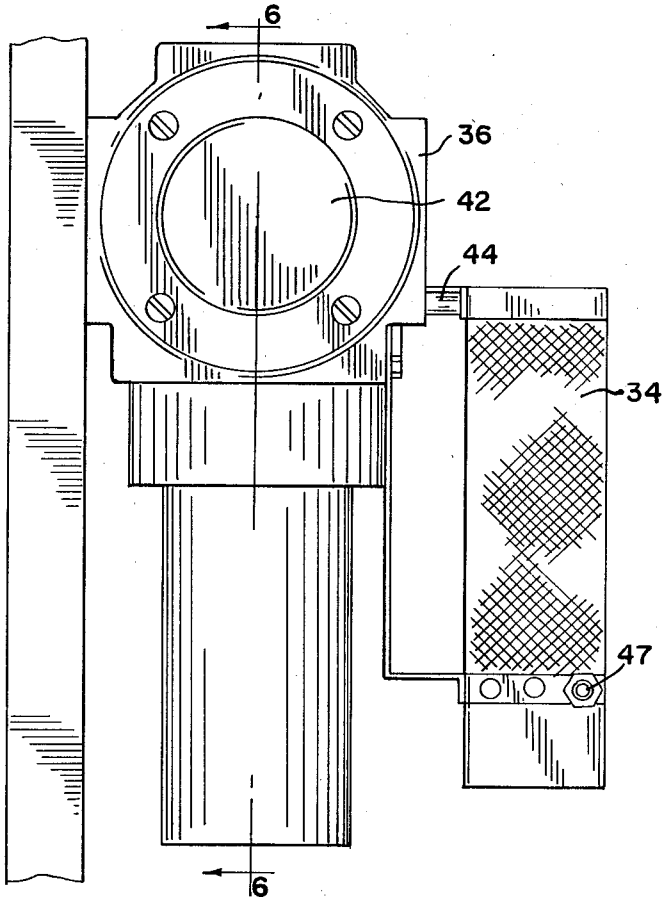
FIG. 4 is a side elevational view of the apparatus shown in FIG. 2.
Figure 3:
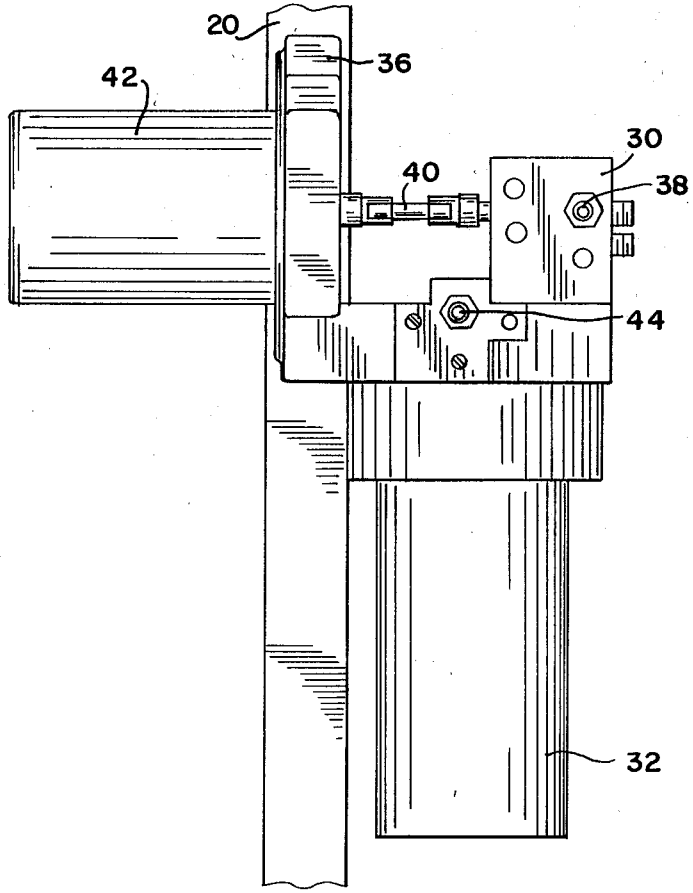
FIG. 3 is a front elevational view of the apparatus as illustrated in FIG. 2.
Figure 5:
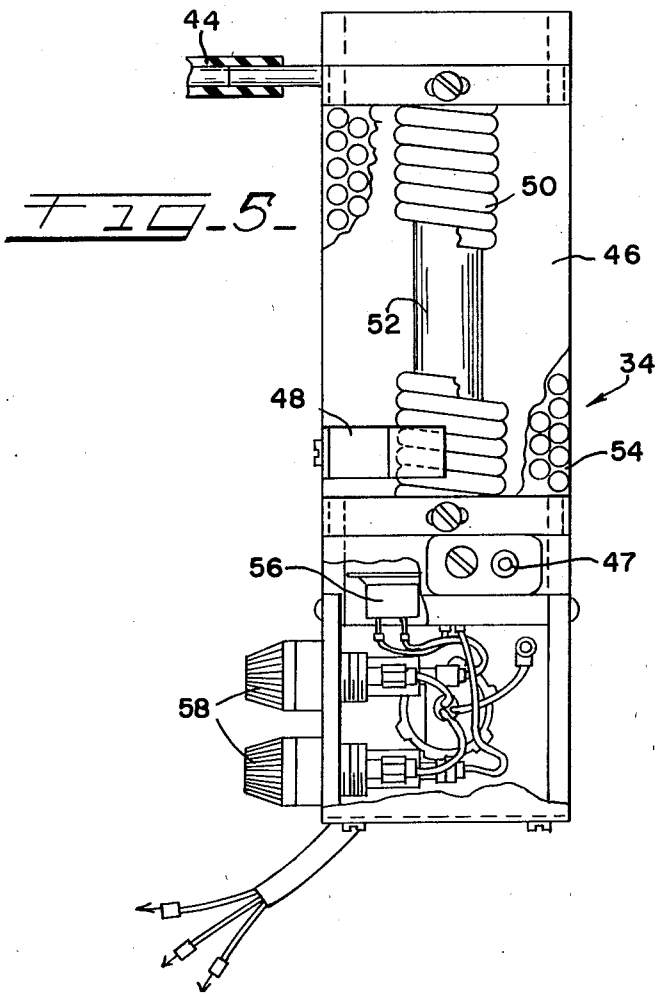
FIG. 5 is a sectional view of the lubricant heater means of the present invention.

The now filtered lubricant flows from the filtering means 32 to the lubricant heater means 34 whereat the lubricant is heated or warmed to a predetermined or preset temperature independent of the machine operation. The lubricant heater means 34 is fluidically connected to the filtering means 32 via conduit means 44 (FIG. 2). As best seen in FIG. 5, the lubricant heater means includes a support means 46 which is fixedly secured to the housing 36 by means of a bracket 48 and suitable fastener means. The lubricant heater means further includes a spiral loop of tubing or conduit 50 wound about an electronically operated firerod cartridge heater means 52. The heating element 52 may be of the type sold by Watlow Industries under Model No. PL 5A-165. A shroud 54 is disposed about the heating element and spiral loop to prevent inadvertent operator injury. The operation of the heater element is controlled by a thermostat means 56 which senses the temperature of the flowing lubricant. That is, the thermostat permits the heater to heat or warm the lubricant independent of the operation of the sewing machine to a preset or predetermined temperature. In the preferred embodiment, the predetermined temperature is approximately 125±10 degrees fahrenheit. For purposes of safety, a set of fuses 58 may be provided in the electrical circuitry of the heater assembly 34 to prevent operator injury. Having once adequately warmed the lubricant, the thermostat means 56 serves to shut off the heating element 52 while maintaining to sense the temperature of the lubricant. From the lubricant heater means, the lubricant is delivered via conduit 47 to the lubricant distribution or reception means 26 and ultimately, in metered quantities, to the operable mechanisms of the machine.

Figure 6:
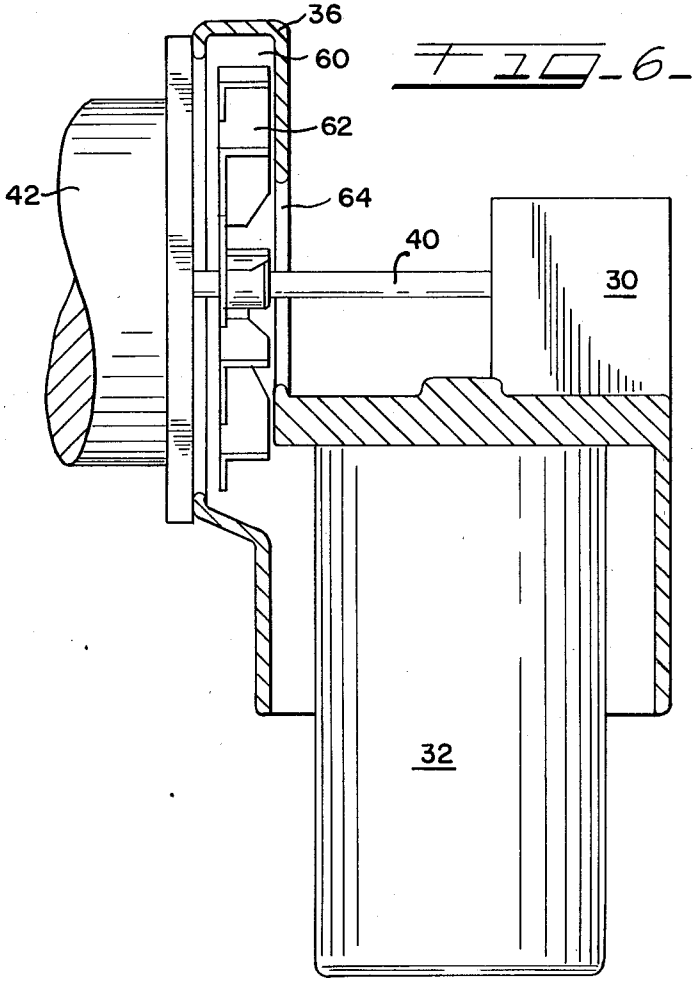
FIG. 6 is a sectional view taken along line 6—6 of FIG. 4.

Obviously during the continued high speed running of the machine, the frictional characteristics of the moving parts will generate a certain amount of heat. This heat is absorbed by the lubricant circulating through the system. To reduce the temperature of the lubricant, there may be provided means for maintaining a continuous circulation of relatively cool air over the surface area of the filtering means 32. This circulating air over the surface area of the filtering means picks up heat by means of convection and carries it out into the atmosphere thereby preventing overheating of the lubricant and consequently maintaining the working parts of the machine at a preferred temperature while being constantly lubricated. To this end, and as best seen in FIG. 6, there may be provided in the housing 36 an air chamber 60. Within the air chamber there is arranged an air pump 62 in the nature of a rotary fan secured upon the drive shaft 40. During operation of the pump means, the air pump draws cool air from the atmosphere through aperture 64 and forces same through the housing 36. The forced air is exhausted around and about the longitudinal surface area of the filtering means 32. This constant circulation of relatively cool air over the surface area of the filtering means 32 carries away the excess heat and serves to maintain the desired lubricant temperature.

Figure 7:
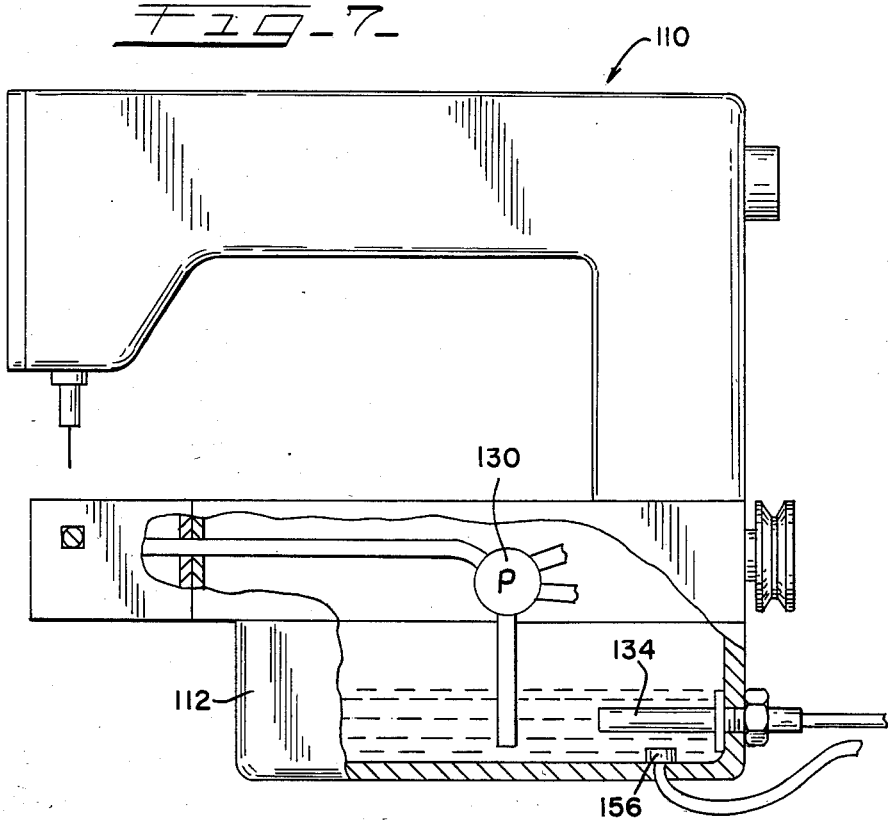
FIG. 7 is a schematic representation of a second embodiment of the present invention.

A second embodiment of the present invention is illustrated is FIG. 7. In this illustrative embodiment, there is provided a sewing machine 110 provided with lubricant reservoir means 112 arranged on the open underside of the sewing machine frame. Like any sewing machine, a plurality of operative mechanisms may be disposed throughout the frame of the machine 110. A lubricant pump means 130, which may be operated independent of the sewing machine, serves to supply lubricant to the various mechanisms of the machine. The lubricant pump means 130 has its intake fluidically connected to the reservoir means and the discharge end communicatively associated with the bearing surfaces requiring lubricant. Disposed in the lubricant reservoir is a lubricant heater means 134 which is operated independent of the sewing machine operation. The lubricant heater means 134 may be of the same make and model as described above and serves to warm the lubricant collected in the reservoir independent of the sewing machine operation. As in the first embodiment, the heater means is controlled by a thermo responsive element 156 for sensing the optimum temperature of the lubricant. That is, once the temperature of the lubricant is raised to a predetermined optimum temperature, the heater element is shut off. When the lubricant temperature drops below the optimum lubricant temperature, the heater means is again warmed whereby warming the lubricant to the desired temperature. Because the heater element is operated independent of the sewing machine operation, the lubricant may be warmed prior to initiation of the sewing machine operation.

An exemplary operative procedure according to the first embodiment of the invention will now be described. The pump means 30 serves to create or initiate a pressurized flow of lubricant from the pump means toward the sewing machine. Because the pump means may be operated independent of the sewing machine operation, the above effect may be accomplished before the sewing operation commences. Accordingly, machine cycling can start with optimum oil pressure and flow to all bearing surfaces. Moreover, the lubricant may be selectively warmed or heated to a preset temperature by the lubricant heater means 34. The warming or heating of the lubricant independent of the machine operation modifies the viscosity of the oil whereby reducing the machine power consumption and machine acceleration times during the early stages of machine operation and during low machine duty cycles. Additionally, the filtering apparatus 32 of the present invention provides the capability of filtering the lubricant before it is presented to the bearing surfaces of the machine. The oversized filter acts to increase the volumetric capacity of the lubrication system and, accordingly, contributes to the cooling of the sewing machine. If desired, the cooling effect created when the air pump 62 forces cooling air over the longitudinal surface area of the filter can only enhance continued machine operation.

Thus there has been provided, in accordance with the invention, a Sewing Machine Lubrication System that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Having thus adequately described the invention, what we claim is:

1. A lubrication system for a sewing machine, said lubrication system comprising:

means operated independently of said sewing machine for providing lubricant under pressure to various parts of said sewing machine wherein said lubricant providing means includes an independently driven motor which drives said lubricant providing means directly via a shaft; and means for filtering the lubricant before it is presented to the various parts of said sewing machine means operated independently of said sewing machine for heating said lubricant to a preset temperature; and means driven by said shaft for circulating air about the filtering means.

2. The invention of claim 1 wherein said circulating means includes fan means.

3. A sewing machine having a frame, operating mechanisms in said frame, means for distributing lubricant to said operating mechanisms, a reservoir for collecting lubricant, and a device for creating and maintaining a pressurized flow of lubricant to said operating mechanisms, said device comprising:

lubricant pump means operated independent of sewing machine operation and having an inlet and outlet;

conduit means operatively connecting said pump means outlet to said lubricant distribution means and said pump inlet to said reservoir; and lubricant heater means operated independently of said sewing machine and associated with said conduit means for warming said lubricant to a preset temperature, said heater means including control means to sense the lubricant temperature and maintain it at said preset temperature, said conduit means including a spiral loop of tubing wound about said lubricant heater means.

4. The invention according to claim 3 further including lubricant filter means interposed between said pump means outlet and the spiral loop of tubing.

5. A sewing machine having a frame, a plurality of operative mechanisms disposed in said frame, means for automatically lubricating the bearing surfaces of said operative mechanisms, comprising:

lubricant reservoir means;

lubricant pump means having an intake fluidically connected with said reservoir means and whose discharge end communicates with the bearing surfaces requiring lubrication;

means for directly driving said pump means via a shaft indpendent of sewing machine operation;

means operated independent of sewing machine operation for warming the lubricant before it is communicated to the bearing surfaces, said means for warming permitting warming of the lubricant to a preset temperature before sewing machine operation commences;

means for filtering the lubricant before warming same; and means driven by said shaft means for cooling the surface area of said filtering means.

6. The invention according to claim 5 wherein said cooling means includes a fan.

7. In combintion, a stand comprising a table top and legs for supporting said table top, a sewing machine mounted on said table top, said sewing machine including operating mechanisms and an internal system for lubricating said mechanisms, a lubricant reservoir for collecting lubricant, and means for circulating lubricant through said system, said circulating means comprising:

lubricant pump means mounted upon said stand for creating and maintaining a flow of lubricant from said lubricant reservoir to said internal lubrication system;

means for heating said lubricant independent of sewing machine operation to a preset temperature;

lubricant filter means being interposed between said lubricant pump means and said heater means; and common support means carrying said lubricant pump means, said lubricant heating means, and said lubricant filtering means.

8. The invention according to claim 7 further including means for circulating air about said filtering means.

9. The invention according to claim 8 wherein said circulating means includes a fan mounted in a chamber provided in said common support.

* * * * *